US006789848B2

(12) United States Patent
Rauschenberger et al.

(10) Patent No.: US 6,789,848 B2
(45) Date of Patent: Sep. 14, 2004

(54) ARTICULATION MECHANISM PARTICULARLY FOR LOUNGE CHAIRS

(75) Inventors: Jörg Rauschenberger, Asperg (DE); Marion Baumgärtel, Tamm (DE)

(73) Assignee: Rauschenberger Metallwaren GmbH, Asperg (DE)

( * ) Notice: Subject to any disclaimer, the term of this patent is extended or adjusted under 35 U.S.C. 154(b) by 0 days.

(21) Appl. No.: 10/604,632

(22) Filed: Aug. 6, 2003

(65) Prior Publication Data

US 2004/0108764 A1 Jun. 10, 2004

(51) Int. Cl.[7] ..... A47C 1/025

(52) U.S. Cl. ..... 297/369; 5/111; 5/178; 297/354.12; 297/356; 297/366; 297/364; 403/93; 403/95

(58) Field of Search ..... 297/354.12, 356, 297/363–366, 369, 378.1, 378.12; 5/111, 178; 403/93, 95

(56) References Cited

U.S. PATENT DOCUMENTS 2,911,245 A * 11/1959 Kurz ..... 297/369
3,232,136 A * 2/1966 Bahmuller ..... 297/366
3,304,107 A * 2/1967 Bahmuller ..... 403/93
3,352,580 A * 11/1967 Kurz et al. ..... 297/366
3,779,655 A * 12/1973 Toyota ..... 403/93
3,918,822 A * 11/1975 Rauschenberger ..... 297/354.12
4,354,710 A * 10/1982 Rauschenberger ..... 297/356
5,169,257 A * 12/1992 Liou ..... 297/356

FOREIGN PATENT DOCUMENTS

CH 358 289 11/1961
FR 1 225 971 7/1960

* cited by examiner

*Primary Examiner*—Peter R. Brown
(74) *Attorney, Agent, or Firm*—Gudrun E. Huckett

(57) ABSTRACT

An articulation mechanism has a central part and a head part each made of a pair of shaped elements. The pairs of shaped elements form inner and outer shells. The inner shells are positioned inside the outer shells. The pairs of shaped elements are pivotable relative to one another and lockable relative to one another in several positions in one pivot direction. The outer shells have inwardly oriented projections and the inner shells have openings. A slide is moveably arranged inside the inner shells. The slide has locking members projecting through the openings of the inner shells and engaging intermediate spaces of the projections. A spring acts on the slide in an engagement direction of the locking members relative to the projections. The projections are shaped such that the locking members automatically reach a locking position in a first pivot direction of the head part.

16 Claims, 6 Drawing Sheets

ARTICULATION MECHANISM PARTICULARLY FOR LOUNGE CHAIRS

BACKGROUND OF INVENTION

1. Field of the Invention

The invention relates to an articulation mechanism having a center part and a head part, particularly for lounge chairs such as garden lounge chairs or camping beds.

2. Description of the Related Art

Lounge chair articulation mechanisms are provided in order to connect a head section with a lounge chair frame in a pivotable way and to foldably connect a leg part that serves as a support to the lounge chair frame. The head section is to be adjustable in several angular positions relative to the remaining lounge chair surface. In the case of known lounge chair articulation mechanisms, it is first required to fold out the leg part before pivoting of the head section relative to the remaining part of the lounge chair is carried out. However, this operational sequence is not always ensured and, when the articulation mechanism is accidentally mishandled, the head section must be folded back and the leg part must then be moved into its supporting position.

SUMMARY OF INVENTION

It is an object of the present invention to provide an articulation mechanism, particularly for lounge chairs, which is of a simple configuration but can still be safely and reliably handled.

In accordance with the present invention, this is achieved in that the articulation mechanism, particularly for lounge chairs, comprises a central part and a head part, wherein the head part and the central part are comprised of shaped elements interacting in pairs and having sockets formed thereon. One of the shaped element pairs is configured as inner shells and the other shaped element pair is configured as outer shells, wherein the shaped element pairs are pivotable relative to one another and are lockable relative to one another in one movement direction in several positions. The outer shells have inwardly oriented projections; between the inner shells a movable slide is arranged. Teeth are formed on the slide and act as locking members which project through openings in the inner shells and engage intermediate spaces of the projections of the outer shells. The slide is biased by a spring in the engagement direction of the locking members. The shape of the projections is such that the locking members automatically reach a locking position in one pivot direction of the head part.

The articulation mechanism according to the present invention is characterized, inter alia, in that it is comprised of a very small number of shaped elements that can be easily manufactured and easily mounted. Depending on the required force acting as torque on the slide, the teeth can be sized accordingly.

Instead of two locking members, additional locking members in the form of teeth neighboring the spring can be provided or the locking members themselves can be reinforced by providing for the slide a material with higher strength or by manufacturing the slide of a thicker material. The slide comprises a bent section so that the slide extends laterally adjacent to a rivet which forms a pivot axis of rotation of the shaped element pairs of the center part and the head part that are pivotable relative to one another.

In a preferred embodiment of the invention, on the outer shells several projections are arranged in a first group and the same number of projections of a second group are positioned diametrically opposite to the projections of the first group. Between the projections, intermediate spaces with identical contact surfaces and/or glide surfaces for the slide or its elements are formed. These groups with differently shaped projections and thus also different intermediate spaces. This makes it possible that one of the groups provides a locking action and enables in one direction a forward movement with catch action, while the projections of the other group provide only a locking action and thus a force transmission. The projections of the first group each have a slanted surface on which a leading edge of the slide glides upon pivoting of the head part in one pivot direction.

In order to lock the slide as needed such that it can be locked with regard to movement in its longitudinal direction upon certain pivot movements of the head part relative to the center part, measures can be provided by which the slide, i.e., its teeth neighboring the spring, is moved transversely to the longitudinal direction of the slide and engages behind a step of the corresponding opening of the inner shell. In addition, or as an alternative, the slide is provided on a lateral edge with an additional tooth which engages a guide slot in one of the inner shells, wherein the guide slot has a section on which a step is formed. Such a configuration of the additional tooth should be provided particularly in such arrangements in which only the leading end of the slide is provided with locking members. In order to lock the slide relative to its longitudinal movement in a certain angular position of the head part relative to the center part, or to release the locking action in a different angular or pivot position, additional projections are formed on the outer shells, wherein it is expedient that one of these additional projections is correlated with the first group of projections and the other additional projection is correlated with the other group of projections.

The spring is simply arranged in a socket formed by the shaped elements wherein the spring is supported on a spring stop which is formed as a unitary part of the shaped elements.

According to a preferred embodiment, the articulation mechanism according to the invention is provided with a leg part which is supported pivotably on the center part.

The leg part is comprised preferably of a hollow profiled section which has at its end two parallel wall parts with congruent bores for receiving a component serving as a pivot axis, wherein these wall parts serve for forming a hinge together with the shaped element pair that forms the center part. In a preferred embodiment, a first outer shell of a shaped element pair is provided with a shaped portion which cooperates with a wall part forming the hinge. This shaped portion is preferably essentially shaped like a circular segment and on the first wall part a concave gliding contour is formed having a curvature that is matched to the radius of the circular segment.

In order to ensure that the head part can not be folded out away from the center part before the leg part has been moved into the folded-out position, it is expedient that a second outer shell of a shaped element pair has a unitary projecting member which extends in the axial and radial direction and that the second wall part of the leg part has such a contour that, depending on the pivot angle of the leg part, the projection cooperates with the wall part or is released. Depending on the shape of this wall part, it may also be possible that the leg part is first pivoted open by a certain pivot angle and the remaining pivoting action is realized in a forced way simultaneously with the folding action of the head part away from the center part.

In an expedient configuration, the center part has correlated therewith the inner shells and the head part has correlated therewith the outer shells. Of course, it is also possible to reverse this arrangement, i.e., the outer shells are components of the center part. In order to prevent damage to the articulation mechanism by penetration of sand, dirt or the like, the inner hollow space containing the movable parts should be sealed off relative to the exterior. It is therefore expedient to provide the inner shells each with a rim oriented toward one another so that a contour closed off to the exterior is provided.

The invention will be explained in the following in more detail with the aid of the drawings showing an articulation mechanism for a lounge chair.

DETAILED DESCRIPTION

Figure 1:
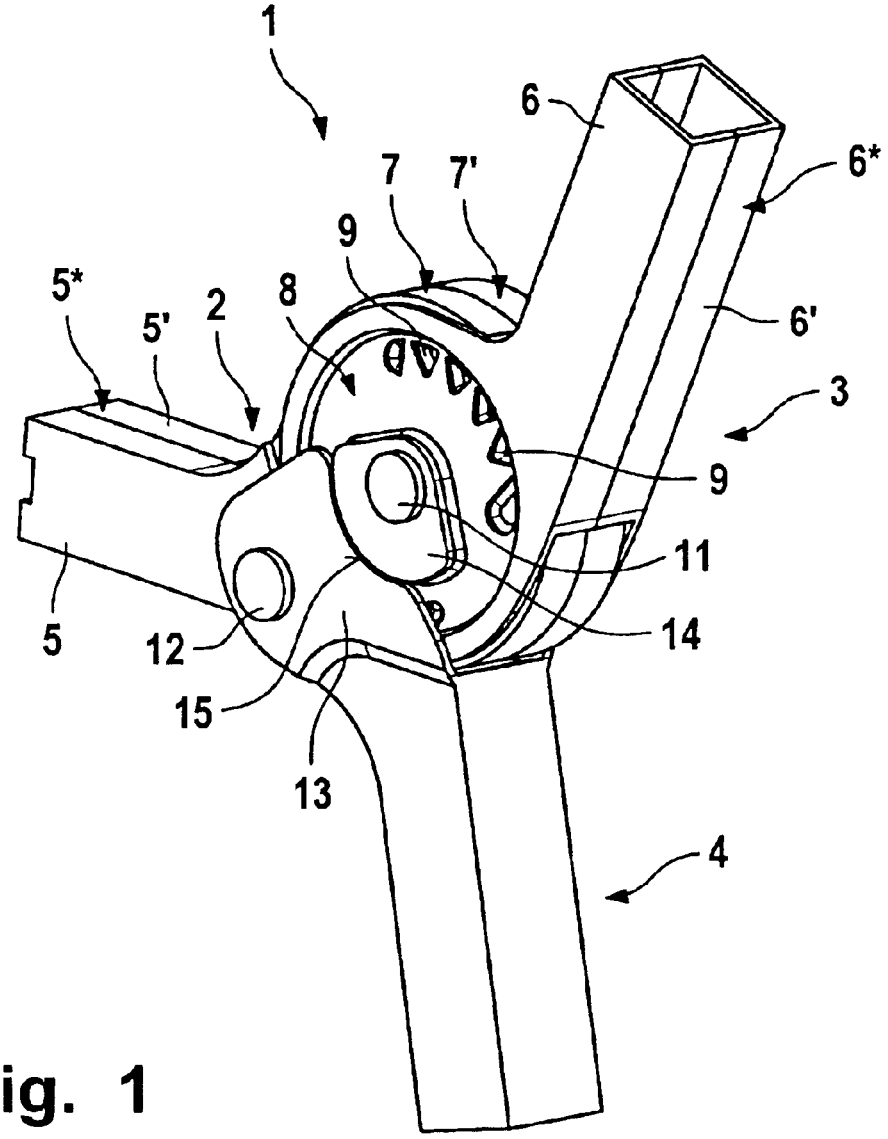
FIG. 1 is a perspective illustration of a lounge chair articulation mechanism in the position of use.

FIG. 1 shows a lounge chair articulation mechanism 1 in a perspective view in its position of use. This lounge chair articulation mechanism 1 comprises a center part 2, a head part 3 as well as a leg part 4; in this connection, the term leg part refers to the support leg of a lounge chair. The center part 2 is comprised of two shaped elements 5, 5'; in the illustrated embodiment, they are shaped sheet metal pieces. These shaped sheet metal pieces 5, 5' comprise inner shells 7, 7' and form a socket 5* by means of an elongate area. The head part 3 is comprised of two shaped elements 6, 6', also embodied as shaped sheet metal pieces comprising each an outer shell 8 wherein the elongate sections of the shaped sheet metal parts 6, 6' form a socket 6*. The outer shell 8 is provided with several impressions which form inwardly oriented projections 9; they will be discussed in more detail in connection with the other Figures. The inner shells 7, 7' and the outer shell 8 are arranged concentrically to one another. A rivet 11 extends through a central bore in each one of these shells; the rivet 11 forms the axis of rotation or pivot axis for the center part 2 and the head part 3 forming the articulation.

The leg part 4 comprises wall parts at its upper end; FIG. 1 only shows one wall part 13 connected by means of a rivet 12 like a hinge to the center part 2 formed of the shaped sheet metal parts 5, 5'. In order to ensure locking of the leg part 4 in the position of use, the outer shell 8 is provided with an outwardly projecting embossment 14 having essentially the shape of a circle sector wherein the arc surface of the embossment 14 cooperates with a glide contour 15 provided on the wall part 13 having a curvature matched to the radius of the circle sector. It can be seen that the leg part 4 can be pivoted toward the center part 2 only when the head part 3 is folded inwardly and, in this way, the embossment 14 is positioned outside of the pivot area of the wall part 13.

Figure 2:
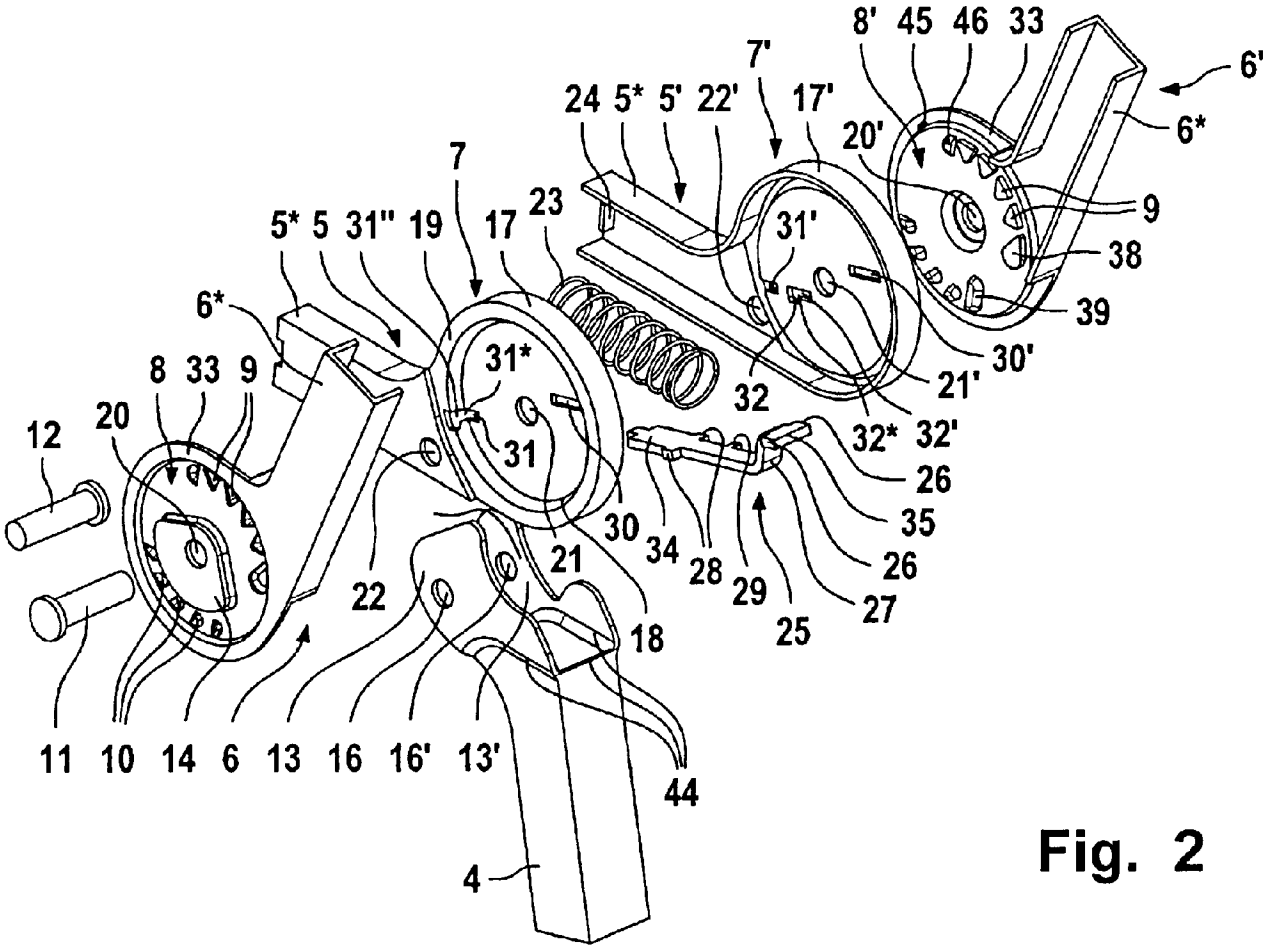
FIG. 2 is an exploded view of the lounge chair articulation mechanism according to FIG. 1.

FIG. 2 shows an exploded view of the articulation mechanism 1. This Figure shows that the shaped sheet metal parts 5, 5' form therebetween a hollow space into which a slide 25 and a spring 23 are inserted. The spring 23 is positioned in a socket 5* formed by the shaped sheet metal parts 5, 5' and is supported with the outer end on a spring stop 24 that is a monolithic part of the shaped sheet metal parts 5, 5'. The inner shells 7, 7' are provided with slot-shaped openings 30, 30', 31, 31' through which teeth project that are provided on the slide 25 and act as looking members 26, 28. The slide 25 has a bent section 27 having at its forward end the looking members 26 provided with a straight leading edge 35. The spring 23 is acting on a section 34 of the slide 25, and in the vicinity of this section two lateral teeth are provided which act as looking members 28.

The slide 25 is inserted with the looking members 26 into the openings 30, 30' and with the looking members 28 into the openings 31, 31'. On the inner shell 7, the opening 31 has a section 31" on which a step 31* is formed behind which the locking members 28 can be hooked. It may be advantageous to provide in addition to this hooking function on a lateral edge of the slide 25 an additional tooth 29. This tooth engages a guide slot 32 of the inner shell 7' and reaches in a certain position of the slide a section 32' of the guide slot 32 behind a step 32* so that the slide 25 can no longer be moved.

The two inner shells 7, 7' have depressions 18 which are circular and are positioned at a certain spacing relative to the rims 17, 17'. The spaced arrangement creates an annular surface 19. The two shaped sheet metal parts 5, 5' rest against one another by means of the open edges of the rims 17, 17' and form a closed hollow space between the inner shells 7, 7'. In the depressions 18 of the inner shells 7, 7', the outer shells 8, 8' of the shaped sheet metal parts 6, 6' are arranged. They have inwardly oriented projections 9,10, 38, 39 cooperating with the locking members 26 and 28. The engagement of the locking members 26, 28 in the intermediate spaces between the projections 9 and 10 can be seen in particular in FIG. 5.

As is also illustrated in FIG. 2, a first group of projections comprises several projections 9 as well as a projection 38 and a projection 46; a second group of projections positioned diametrically opposite to the first group comprises projections 10 and includes a projection 39. The shape of the projections of the respective group is selected such that between them intermediate spaces result which form identical locking surfaces and glide surface—with the exception of projection 38. The function of the projections 38 and 39 will be explained in more detail in connection with FIGS. 6 and 7. The outer shells 8, 8' have at their periphery a circumferentially extending flange 33 which covers the annular surface 19 of the inner shells 7, 7' and in this way prevents the penetration of dirt into the recess 18.

As can be seen in FIG. 2, the outer shells have central bores 20, 20' and the inner shells 7, 7' have central bores 21, 21' through which the rivet 11 extends that provides a pivot axis for the shaped sheet metal parts of the center part and of the head part pivotable relative to one another. Bores 22, 22' are provided on the shaped sheet metal parts 5, 5' which are congruent to one another. The leg part 4 has at its upper end the already mentioned wall part 13 and a parallel extending wall part 13', wherein the two wall parts 13,13' are provided with congruent bores 16, 16'. The leg part 4 engages with its wall parts 13, 13' the center part 2 and the rivet 12 extends through the bores 16, 16', 22, 22' so that the axis of rotation (pivot axis) for the hinge-like articulation mechanism between the center part 2 and the leg part 4 is formed. The configuration of the embossment 14 and of the gliding contour 15 has been described already in connection with FIG. 1. In addition, FIG. 2 also shows that a projecting member 45 is formed as a monolithic part of the outer shell 8' and extends radially and axially outwardly. Its function will be explained in the following in connection with FIG. 3. On the leg part 4 support edges 44 are formed; they rest in the position of use of the lounge chair articulation mechanism against the outer circumference of the shaped sheet metal parts 5, 5'.

Figure 3:
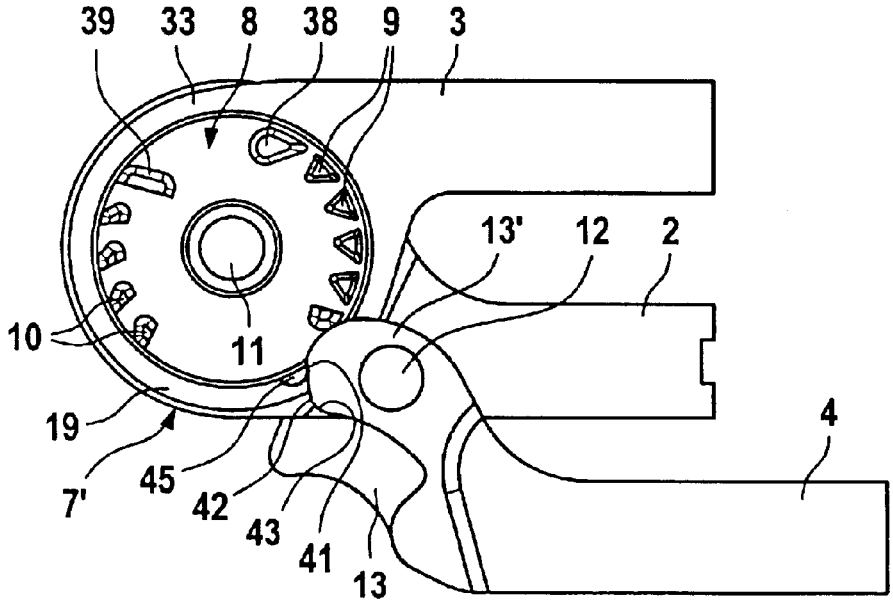
FIG. 3 is a side view of the lounge chair articulation mechanism in the folded state.

FIG. 3 shows a side view of the lounge chair articulation mechanism 1 in the folded state. The sockets 5* and 6* are parallel to one another, i.e., the head part 3 is pivoted onto the center part 2. The leg part 4 is also pivoted onto the center part 2 and extends also essentially parallel to the center part 2. The projecting member 45 formed on the outer shell 8' is positioned against a locking edge 41 of the wall part 13' so that it is prevented that the head part 3 can be folded out as long as the leg part 4 has not yet been pivoted by a predetermined angle about the rivet 12. In this way, a sequence for manipulating the lounge chair is ensured, i.e., the leg part 4 must be pivoted first before pivoting of the head part 3 is enabled. The configuration of the wall part 13' illustrated in FIG. 3 has a transitional portion 42 adjoining a driver section 43 so that the leg part 4 must be moved at least with its transitional portion 42 past the projecting member 45 in order to enable movement of the head part 3 relative to the center part 2. If the leg part 4 has not been completely folded out, the movement of the head part 3 relative to the center part 2 generates the residual pivoting action of the leg part 4 by means of force introduction of the projecting member 45 onto the driver section 43. For identical parts, the reference numerals in FIG. 3 match those of FIGS. 1 and 2.

Figure 4:
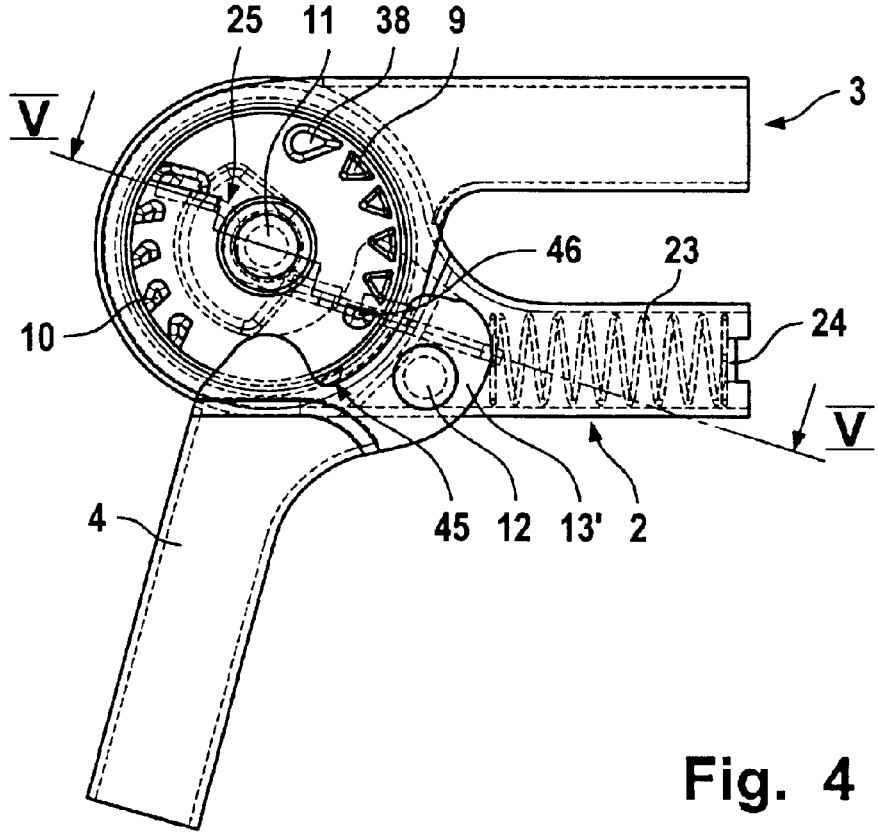
FIG. 4 is an illustration according to FIG. 3 showing the leg in the folded-out position and indicating in dashed lines the slide and the spring.

FIG. 4 shows a side view of the lounge chair articulation mechanism 1 with completely folded-open leg part 4 but with the head part 3 still in the folded position. In addition to the illustration of FIG. 3, FIG. 4 shows in dashed lines the position of the slide 25 and of the spring 23 acting on it.

Figure 5:
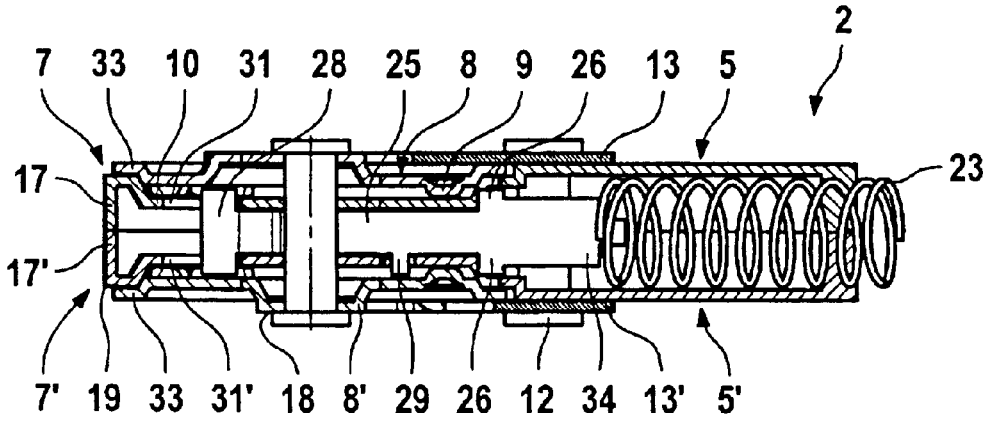
FIG. 5*a* section along the line V—V of FIG. 4 in an enlarged illustration.

FIG. 5 shows a section along the line V—V of FIG. 4. This illustration shows that the rims 17, 17' of the inner shells 7, 7' rest against one another and in this way form a hollow space within the inner shells which is closed off to the exterior. On the outer sides the inner shells 7, 7' are covered by the outer shells 8, 8' wherein the flange 33 rests against the annular surface 19 and in this way prevents the penetration of dirt. The slide 25 is in the end position into which it is moved against the force of the spring 23 so that the looking members 26 and 28 are moved out of the intermediate spaces between the projections 9 and 10. FIG. 5 also shows that the looking members 26 and 28 project so far into the hollow space formed by the outer shells 8, 8' that upon engagement between the projections 9 and 10 a locking action against pivoting of the head part 3 relative to the center part 2 is achieved.

Figure 6:
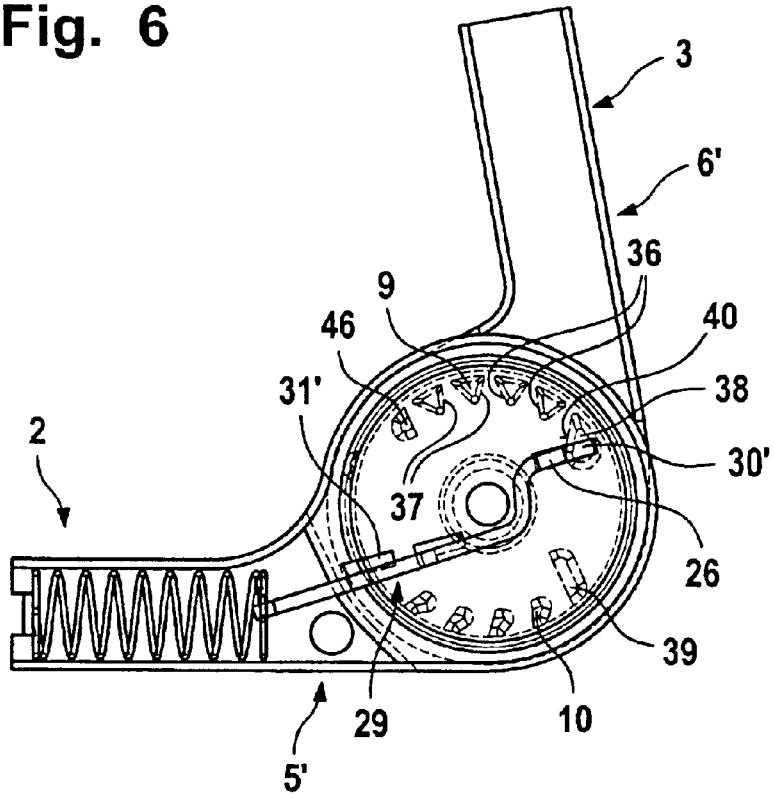
FIG. 6 is a representation of the inner contour side of the lounge chair articulation mechanism with the slide arranged therein shown in a first operational position.
Figure 7:
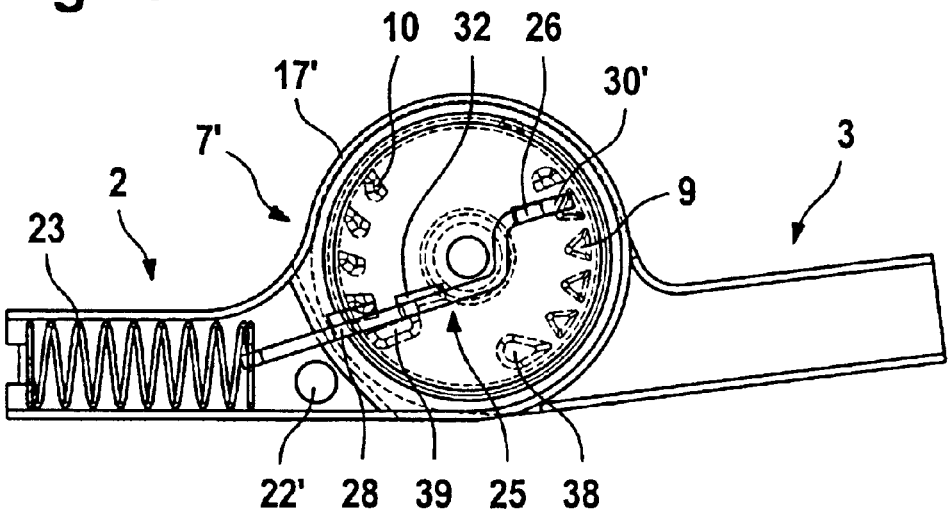
FIG. 7 is an illustration according to FIG. 6 in a different operational position.
Figure 8:
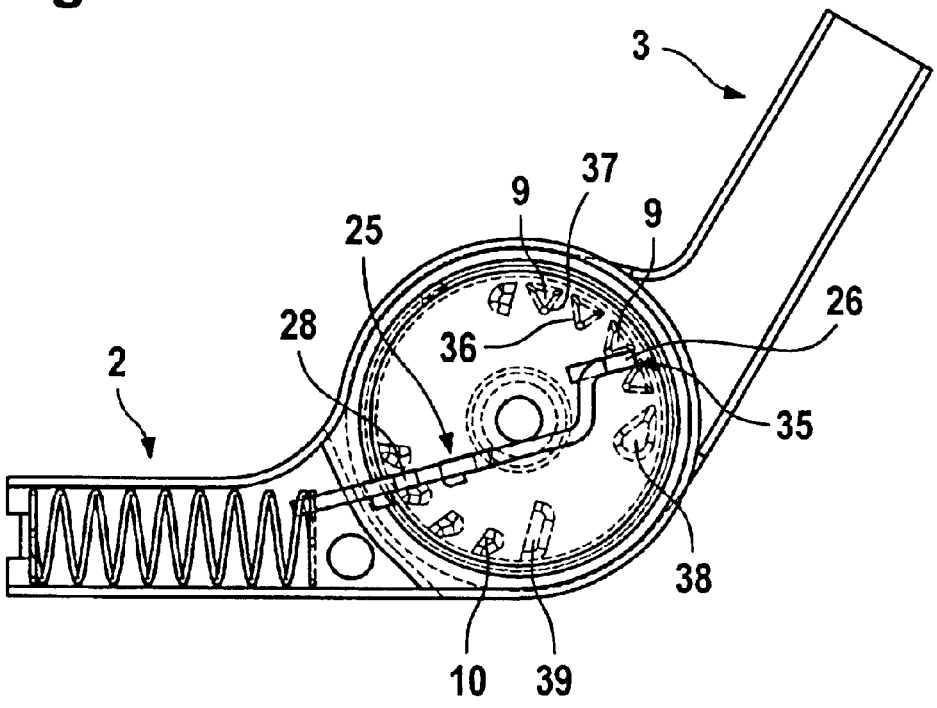
FIG. 8 is an illustration according to FIG. 6 in a locking position.

FIGS. 6 through 8 show the inner side of the center part 2 and the head part 3 in different operational positions of the articulation mechanism. Since in the folded state according to FIG. 4, the slide 25 is in the position in which it is moved against the spring 23 and secured in this position in an immobile way, upon folding open the articulation mechanism, i.e., pivoting the head part 3 relative to the center part 2—in the example of FIG. 6 in the clockwise direction—no locking action is effected because the projections 9 and 10 are outside of the movement path of the looking members 26, 28.

When the head part 3 reaches the position illustrated in FIG. 7, the projection 39 comes to rest against the slide 25, in particular on the additional tooth 29, and in this way moves the slide 25, i.e., its teeth 28 and 29, out of engagement behind the projections 31*, 32* into a position in which the locking members and the additional tooth are no longer secured; the slide 25 is now movable longitudinally.

When the head part 3 is pivoted from this position in a counterclockwise direction, as illustrated in FIG. 8, the leading edge 35 of the slide 25 glides along the slanted surfaces 36 on the projections 9 and the slide 25 is moved against the spring 23 to such an extent that the locking members 26 and 28 are moved past the projections 9 and 10, respectively, and then lock behind them as a result of the action of the spring 23. Accordingly, in the desired position the locking surface 37 of the projection 9 rests against the locking member 26 and the diametrically oppositely positioned projection 10 rests against the locking member 28.

When a more upright position of the head part 3 is desired, a movement is possible in a counterclockwise direction, as described above. For lowering the head part 3, the slide 25 must be moved into a position in which the locking members 26, 28 cannot engage the projections 9 and 10. For this purpose, a long side 40 is provided on the projection 38 by which the slide 25 can be moved against the spring 23 until the locking member 28 or the additional tooth 29 reaches the sections 31" and 32' of the guide slots so that the area 34 of the slide 25 is pushed by the spring into a position behind the projections 31*,32*. In this way, the slide is no longer movable in the longitudinal direction in this position.

Figure 9:
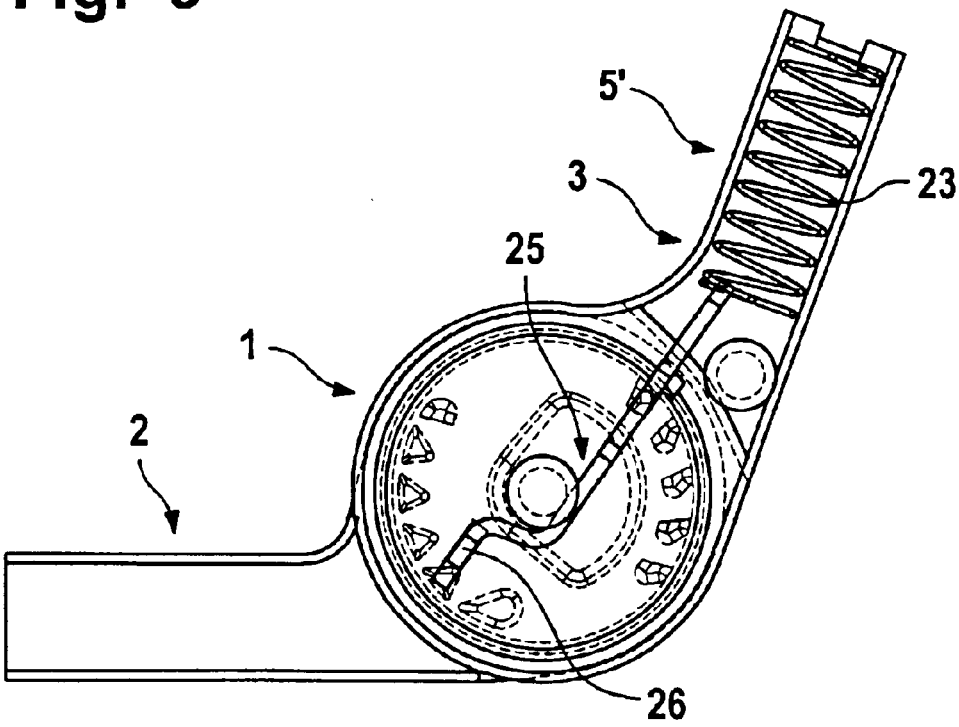
FIG. 9 is an alternative embodiment of FIG. 8.

FIG. 9 shows an alternative configuration of the center part 2 and of the head part 3 where the inner shells 7 are components of the head part and the outer shells 8 components of the center part. This configuration requires that the spring 23 is arranged in the socket 6* of the head part. Otherwise, the arrangement is identical.

While specific embodiments of the invention have been shown and described in detail to illustrate the inventive principles, it will be understood that the invention may be embodied otherwise without departing from such principles.

What is claimed is:

1. An articulation mechanism comprising:

a central part and a head part, wherein the head part and the central part each are comprised of a pair of shaped elements forming a socket;

wherein a first one of the pairs of shaped elements is configured as inner shells and a second one of the pairs of shaped elements is configured as outer shells, wherein the inner shells are positioned inside the outer shells;

wherein the first and second pairs of shaped elements are pivotable relative to one another and lockable relative to one another in several positions in a first pivot direction of the head part;

wherein the outer shells have inwardly oriented projections;

wherein the inner shells have openings;

a slide moveably arranged inside the inner shells;

wherein the slide has locking members in the form of teeth projecting through the openings of the inner shells and engaging intermediate spaces of the projections of the outer shells;

a spring acting on the slide in an engagement direction of the locking members relative to the projections;

wherein the projections are shaped such that the locking members automatically reach a locking position in the first pivot direction of the head part.

2. The articulation mechanism according to claim 1, further comprising a leg part pivotably connected to the center part.

3. The articulation mechanism according to claim 2, wherein the center part and the leg part have interacting means for ensuring that the head part is moved only after the leg part has been folded out or moved together with the leg part and for ensuring that the leg part is foldable only after the head part has been folded into a folded position.

4. The articulation mechanism according to claim 1, wherein the slide has a first end remote from the spring and a second end facing the spring, wherein a first one and a second one of the locking members are provided on the first end, wherein the first and second locking members each project through one of the inner shells, and wherein a third one and a fourth one of the locking members are provided near the second end.

5. The articulation mechanism according to claim 1, wherein the slide has a bent section.

6. The articulation mechanism according to claim 1, wherein the projections are arranged in a first group and in a second group, wherein the first and second groups are arranged diametrically opposite one another, wherein between the projections of the first and second groups intermediate spaces of identical shape are formed, respectively.

7. The articulation mechanism according to claim 6, wherein the projections of the first group each have a slanted surface, wherein the slide has a leading edge and the leading edge, upon pivoting of the head part in the first pivot direction of the head part, glides along the slanted surfaces.

8. The articulation mechanism according to claim 1, wherein the slide has a lateral edge provided with an additional tooth, wherein one of the inner shells has a guide slot engaged by the additional tooth, wherein the guide slot has a section provided with a step.

9. The articulation mechanism according to claim 1, wherein a first one of the projections of the outer shells is formed such that at a predetermined first pivot angle the first projection acts on the slide to move the slide into a locking position preventing longitudinal movement of the slide.

10. The articulation mechanism according to claim 9, wherein a second one of the projections is located on the outer shells such that at a predetermined second pivot angle the second projection acts on the slide to release the slide from locking position.

11. The articulation mechanism according to claim 1, wherein the spring is arranged in a first one of the sockets and is supported on a spring stop of the first socket.

12. The articulation mechanism according to claim 1, further comprising a leg part pivotably connected to the center part, wherein the leg part comprises two wall parts having congruent bores, wherein the articulation mechanism further comprises a hinge component inserted into the congruent bores and into the central part so as to form a pivot axis for the leg part.

13. The articulation mechanism according to claim 12, wherein a first one of the outer shells has an embossment interacting with a first one of the wall parts.

14. The articulation mechanism according to claim 13, wherein a second one of the outer shells has a monolithic projecting member extending axially and radially and wherein a second one of the wall parts has a contour configured such that, depending on a pivot angle of the leg part, the projecting member interacts with the second wall part or is released by the second wall part.

15. The articulation mechanism according to claim 1, wherein the inner shells are provided at the center part and wherein the outer shells are provided at the head part.

16. The articulation mechanism according to claim 1, wherein the inner shells each have a rim and the rims face one another and rest against one another so that the inner shells have a closed outer contour.

* * * * *

UNITED STATES PATENT AND TRADEMARK OFFICE

CERTIFICATE OF CORRECTION

PATENT NO. : 6,789,848 B2 
DATED : September 14, 2004
INVENTOR(S) : Jörg Rauschenberger et al.

It is certified that error appears in the above-identified patent and that said Letters Patent is hereby corrected as shown below:

Title page,
Insert Item:
-- [30] Foreign Application Priority Data
Aug. 7, 2002 (DE) 102 36 158.4 --

Signed and Sealed this

Third Day of May, 2005

JON W. DUDAS
*Director of the United States Patent and Trademark Office*